US008668303B2

(12) United States Patent
Sonehara

(10) Patent No.: US 8,668,303 B2
(45) Date of Patent: Mar. 11, 2014

(54) IMAGE RECORDING DEVICE AND METHOD OF IMAGE RECORDING

(75) Inventor: Hideaki Sonehara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 90 days.

(21) Appl. No.: 13/523,212

(22) Filed: Jun. 14, 2012

(65) Prior Publication Data

US 2012/0320119 A1 Dec. 20, 2012

(30) Foreign Application Priority Data

Jun. 17, 2011 (JP) ..... 2011-134931

(51) Int. Cl.
*B41J 29/393* (2006.01)

(52) U.S. Cl.
USPC ..... 347/19; 347/41

(58) Field of Classification Search
USPC ..... 347/19, 41
See application file for complete search history.

(56) References Cited

U.S. PATENT DOCUMENTS 6,623,096 B1 * 9/2003 Castano et al. ..... 347/19
7,380,900 B2 * 6/2008 Kanda et al. ..... 347/19
8,562,099 B2 * 10/2013 Kido ..... 347/19

FOREIGN PATENT DOCUMENTS

JP 2009-292129 12/2009

* cited by examiner

*Primary Examiner* — Lamson Nguyen
(74) *Attorney, Agent, or Firm* — Workman Nydegger

(57) ABSTRACT

An image recording device which includes a control unit which alternately performs, main-scannings in which the recording head is moved in the main-scanning direction while the recording head ejecting the liquid to form line images that extend in the main scanning direction and are adjacent to each other in the sub-scanning direction, and sub-scannings in which the recording head is moved in the sub-scanning direction, and a detection unit which detects a displacement of a mark which is formed on the recording medium in the sub-scanning direction, wherein the control unit adjusts a movement amount of the recording head which is moved in the sub-scanning direction in the sub-scannings on the basis of a detection result of the detection unit.

12 Claims, 8 Drawing Sheets

IMAGE RECORDING DEVICE AND METHOD OF IMAGE RECORDING

This application claims the benefit of Japanese Patent Application No. 2011-134931, filed on Jun. 17, 2011, which is hereby incorporated by reference herein in its entirety.

BACKGROUND

1. Technical Field

The present invention relates to a technique in which an image is recorded by ejecting ink onto a recording medium, and particularly to an image recording technique in which an image is recorded on a recording medium by performing a plurality of main scannings in which a line image is formed by ejecting liquid onto a recording medium from a recording head moving in the main scanning direction.

2. Related Art

In JP-A-2009-292129, an image recording device is disclosed in which an image is printed on a recording medium by ejecting ink as liquid from nozzles included in a recording head opposing to a recording medium which is supported on a platen. The recording head of the image recording device includes a plurality of nozzles aligned in the width direction (sub-scanning direction) of the recording medium, and is configured to be movable in the main scanning direction which is orthogonal to the sub-scanning direction. In addition, the recording head performs the main scanning in which liquid is ejected toward the recording medium from each nozzle while moving in the main scanning direction. By performing the main scanning, a plurality of lines of an image (line images) which are formed by one nozzle, and extend in the main scanning direction are aligned in the sub-scanning direction.

Meanwhile, in the above described image recording device, it is possible to obtain an image with higher resolution by performing a plurality of main scannings. Specifically, it is preferable to perform the plurality of main scannings by alternately executing the main scanning and the sub-scanning in which the recording head is moved in the sub-scanning direction. That is, after a main scanning, a sub-scanning starts scanning, and the recording head moves in the sub-scanning direction. In addition, the main scanning is performed again subsequent to the sub-scanning, and the recording head moves in the main scanning direction. In this manner, a line image due to new main scanning is formed between the plurality of line images which are formed in advance by the previous main scanning. It is possible to print an image with higher resolution by performing the plurality of main scannings by alternately executing the main scanning and the sub-scanning in this manner, and by forming a new line image between the previously formed line images.

However, when such printing is performed, there has been concern that the following problems may arise due to the fact that the recording medium stretches in the sub-scanning direction due to moisture or temperature. That is, in a configuration in which a new line image is formed between the plurality of line images which are already formed, line images which are formed by the main scanning performed at a different time are adjacent to each other in the sub-scanning direction. For this reason, there has been a concern that, when the adjacent line images are formed, the recording medium stretches in the sub-scanning direction before a next main scanning starts, and thus, gaps between the line images, in which liquid (ink) are missed, may occur.

SUMMARY

An advantage of some aspects of the invention is to provide a technique in which an occurrence of a gap between the line images is reduced when a plurality of main scannings are performed. In the technique, a recording head forms line images by ejecting ink onto a recording medium while moving in the main scanning direction. The line images, which are different from each other, are adjacent to each other in the sub-scanning direction and form an image.

According to an aspect of the invention, there is provided an image recording device which includes, a supporting member which supports a recording medium; a recording head which is movable in the main scanning direction and a sub-scanning direction, and ejects liquid onto the recording medium supported by the supporting member; a control unit which alternately performs, main-scannings in which the recording head is moved in the main-scanning direction while the recording head ejecting the liquid to form line images that extend in the main scanning direction and are adjacent to each other in the sub-scanning direction, and sub-scannings in which the recording head is moved in the sub-scanning direction; and a detection unit which detects a displacement of a mark which is formed on the recording medium in the sub-scanning direction, in which the control unit adjusts a movement amount of the recording head which is moved in the sub-scanning direction in the sub-scannings on the basis of a detection result of the detection unit.

According to another aspect of the invention, there is provided a method of image recording including alternately performing, main-scannings in which the recording head moves in the main-scanning direction while the recording head ejecting the liquid to form line images that extend in the main scanning direction and are adjacent to each other in the sub-scanning direction, and sub-scannings in which the recording head moves in the sub-scanning direction; and adjusting the movement amount of the recording head in the sub-scanning on the basis of the displacement, which is the detection result, of the mark having been formed on the recording medium.

According to the aspects of the invention configured in this manner (image recording device and method of image recording), main scanning in which a line image extending in the main scanning direction is formed by ejecting liquid from a recording head while moving the recording head in the main scanning direction, and sub-scanning in which the recording head is moved in the sub-scanning direction are alternately performed. In this manner, a plurality of main scannings are performed, and line images adjacent to each other in the sub-scanning direction are formed by main scannings which are different from each other. For this reason, line images which are formed by the main scannings performed at a different timing are aligned in the sub-scanning direction by being adjacent to each other. In a configuration of the related arts, however, when the recording medium is stretched in the sub-scanning direction, there is a concern that the above described gap may occur.

The aspects of the invention deals with such a problem by adjusting the position at which the line image is formed in the sub-scanning direction. That is, in the aspects of the invention configured as described above, the position of the line image in the sub-scanning direction can be adjusted by changing the position of the recording head performing main scanning for forming the line image in the sub-scanning direction. More specifically, it is possible to adjust the position of the line image in the sub-scanning direction by changing the position of the recording head in the sub-scanning direction in the main scanning which is performed subsequent to the sub-scanning, by adjusting a movement amount of the recording head in the sub-scanning direction in the sub-scanning. Accordingly, if the movement amount of the recording head can be adjusted in the sub-scanning according to the stretching of the recording medium in the sub-scanning direction, it is possible to suppress the occurrence of the above described gap. Accordingly, the invention has a configuration in which a displacement of the mark in the sub-scanning direction which is formed on the recording medium can be detected. Therefore, the aspects of the invention include a configuration in which the displacement of the mark which is formed on the recording medium in the sub-scanning direction is detected. In addition, the movement amount of the recording head in the sub-scanning which is moved in the sub-scanning direction can be adjusted on the basis of the detection result. As a result, it is possible to suppress the occurrence of the above described gap.

In addition, the image recording device may be configured so that the mark is formed on a recording medium with the recording head by ejecting liquid on a recording medium. In this configuration, there is an advantage that the timing or a position at which the mark is formed can be appropriately adjusted.

At this time, the image recording device may be configured so that the control unit adjusts the movement amount of the recording head in the sub-scanning on the basis of the displacement, which is the detection result of the detection unit, of the mark having been formed by the recording head.

In addition, the image recording device may be configured so that the mark is formed on the recording medium with the recording head by ejecting the liquid onto the recording medium while moving in the main scanning direction. With such a configuration, since the mark can be formed while performing the main scanning, there is no need to perform an operation for forming the mark separately, accordingly, it is advantageous in that it improves the printing speed.

At this time, the image recording device may be configured so that the line image is formed after forming the mark in the main scannings. That is, in the above described configuration in which the line image is formed by ejecting the liquid onto the recording medium, the amount of liquid attaching to the recording medium increases every time the forming of the line image increases, accordingly, the recording medium tends to stretching in the sub-scanning direction. In this case, it is preferable to reflect in the displacement of the mark such a stretching of the recording medium occurring due to the formation of the line image. In contrast to this, during main scanning in which the mark is formed during the execution thereof, it is possible to reflect in the displacement of the mark the stretching of the recording medium which occurs at the time of forming the line image, if it is configured such that the line image is formed after forming the mark. As a result, it is possible to further reliably suppress the occurrence of the above described gap.

In addition, the image recording device may be configured so that the mark is formed while performing a first main scanning among a plurality of main scannings which forms the line images adjacent to each other in the sub-scanning direction. With such a configuration, it is possible to reflect the stretching of the recording medium which occurs when forming the line image in each main scanning in the displacement of the mark. As a result, it is possible to further reliably suppress the occurrence of the above described gap.

Meanwhile, there is a case where the stretching of the recording medium is different depending on the position in the sub-scanning direction. Therefore, the image recording device may be configured so that a plurality of marks are formed in different positions from each other in the sub-scanning direction. In this manner, it is possible to detect the difference in the stretching of the recording medium in different positions in the sub-scanning direction using the displacement of the mark. As a result, it is possible to further reliably suppress the occurrence of the above described gap.

In addition, the image recording device may be configured so that the detection unit includes a line sensor of which the longitudinal direction of a detection area is arranged parallel to the sub-scanning direction, and detects the displacement of the mark in the sub-scanning direction on the basis of a detection result of the line sensor. By using such a line sensor, it is possible to reliably grasp the displacement of the mark in the sub-scanning direction.

In addition, the recording medium may be a paper-based medium. Such a paper-based medium is easily stretched by moisture of the liquid or the like ejected from the recording head, and as a result, there is a concern that the above described gap may occur. Therefore, it is preferable to suppress the occurrence of the gap by applying the present invention.

In addition, the recording medium may be a film-based medium. Such a film-based medium is easily stretched by temperature. In particular, in a configuration in which the recording medium which is supported by a supporting member is heated, there is a concern that the stretching due to the temperature becomes significant. Accordingly, it is preferable to suppress the occurrence of the gap by applying the aspects of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
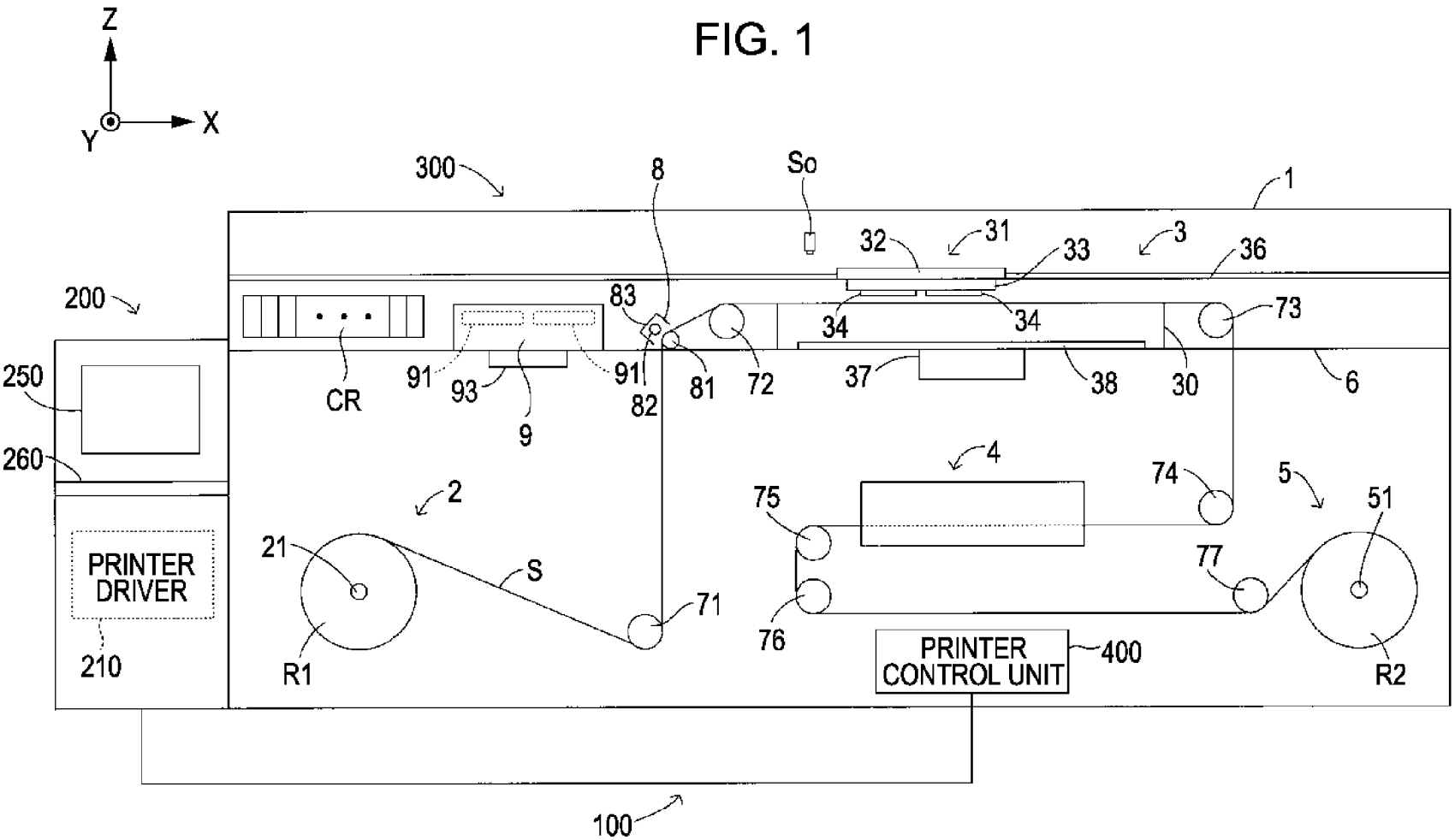
FIG. 1 is a schematic diagram which shows an example of a printing system to which the invention is applicable.

FIG. 1 is a schematic diagram which shows an example of a printing system to which the invention is applicable. In FIG. 1 and following figures, XYZ orthogonal coordinates having the Z axis as a vertical axis are also shown in order to clarify the relationship in arrangement of each unit of the device. In the descriptions below, a direction of each coordinate axis (arrow thereof) is set to the positive direction, the opposite direction thereof is set to the negative direction, the positive side of the Z axis is set to the upper side, and the negative side of the Z axis is set to the lower side to be appropriately dealt with.

A printing system 100 includes a host device 200 which generates printing data based on image data received from an external device such as a personal computer, and a printer 300 which prints an image on the basis of the printing data received from the host device 200. The printer 300 is a printer which prints images on a sheet S using an ink jet method while feeding the elongated sheet S which is wound in a roll shape.

As shown in FIG. 1, the printer 300 includes a main body case 1 which has a substantially rectangular parallelepiped shape. A feeding unit 2 which feeds the sheet S from a roll R1 wound around with the sheet S, a printing chamber 3 which performs printing by ejecting ink onto the sheet S which is sent out, a drying unit 4 which dries the sheet S onto which the ink is attached, and a winding unit 5 which winds the sheet S being dried as a roll R2 are arranged in the main body case 1.

More specifically, the inside of the main body case 1 is partitioned into top and bottom in the Z axis direction by a flat plate-shaped base 6 which is arranged in parallel to the XY plane (that is, horizontally), and the upper side of the base 6 is the printing chamber 3. A platen 30 is fixed to the top face of the base 6 substantially at the center portion in the printing chamber 3. The platen 30 has a rectangular shape, and supports the sheet S from the lower side by the top face thereof which is parallel to the XY plane. In addition, a recording unit 31 performs printing with respect to the sheet S which is supported on the platen 30.

On the other hand, the feeding unit 2, a drying unit 4, and the winding unit 5 are arranged on the lower side of the base 6. The feeding unit 2 is arranged on the lower side of the X axis in the negative direction (obliquely lower side on the left in FIG. 1) with respect to the platen 30, and includes a feeding axis 21 which is rotatable. In addition, the sheet S is wound around the feeding axis 21, and feeding axis supports the roll R1. On the other hand, the winding unit 5 is arranged at the lower side of the X axis in the positive direction with respect to the platen 30 (obliquely lower side on the right in FIG. 1), and includes a paper winding shaft 51 which is rotatable. In addition, the sheet S is wound around a winding axis 51 which is rotatable, and the winding axis supports a roll R2. Further, the drying unit 4 is arranged directly under the platen 30 in between the feeding unit 2 and the winding unit 5 in the X axis direction. In addition, the drying unit 4 is arranged slightly above the feeding unit 2 and the winding unit 5.

In addition, the sheet S which is transported to the winding unit 5 from the feeding unit 2 passes through the printing chamber 3 and the feeding unit 4 in order while being guided by seven rollers 71 to 77. That is, the roller 71 is arranged in the feeding axis 21 in the positive direction of the X axis which is included in the feeding unit 2, and the sheet S which is sent out from the feeding axis 21 in the positive direction of the X axis is wound around the roller 71, and is guided upward.

A ground electrode roller 81 of a corona treatment machine 8 to be described later, and two rollers 72 and 73 are aligned in this order in the positive direction of the X axis inside the printing chamber 3 as the upper side of the roller 71. The ground electrode roller 81 is arranged slightly under the two rollers 72 and 73. For this reason, the sheet S which is guided upward from the roller 71 is wound around the ground electrode roller 81, turns an orientation thereof obliquely upward, and then is wound around the two rollers 72 and 73.

These rollers 72 and 73 are arranged by being straightly aligned in the X axis direction (that is, horizontally) so as to interpose the platen 30 therebetween, and positions of the respective tops are adjusted so as to have the same height as the top face of the platen 30 (a face supporting the sheet S). Accordingly, the sheet S which is wound around the roller 72 horizontally moves (in the X axis direction) while being in sliding contact with the top face of the platen 30 for a period until the sheet S reaches the roller 73. In addition, the sheet S which is wound around the roller 73 is guided downward.

Two rollers 74 and 75 are aligned in this order on the lower side of the roller 73 (lower side than base 6) in the negative direction of the X axis. The sheet S which is wound around the rollers 74 and 75 is guided in parallel to the X axis direction (that is, horizontally) in between both the rollers 74 and 75. In addition, the drying unit 4 is arranged between the rollers 74 and 75. Accordingly, the sheet S which is wound around the roller 74 turns the orientation thereof to the negative direction of the X axis, and passes through the inside of the drying unit 4 during a period in which the sheet S reaches the roller 75.

Two rollers 76 and 77 are aligned in this order in the positive direction of the X axis on the lower side of the roller 75. In addition, the sheet S which is wound around the roller 76 turns the orientation thereof to the positive direction of the X axis, and reaches the roller 77. The sheet S which is wound around the roller 77 is wound around a winding axis 51 of the winding unit 5 which is arranged in the positive direction of the X axis of the roller 77.

In this manner, the sheet S which is sent out from the feeding unit 2 passes through the printing chamber 3 and the drying unit 4, and is wound around the winding unit 5. In addition, printing processing in the printing chamber 3, or a drying treatment of the drying unit 4 is performed with respect to the sheet S.

In the printing processing in the printing chamber 3 is performed by a recording unit 31 which is arranged at the upper side of the platen 30. The printing unit 31 performs printing by ejecting ink which is supplied by an ink supply mechanism (not shown) from an ink cartridge CR which is arranged at the end portion (left end portion in FIG. 1) in the printing chamber 3 in the negative direction of the X axis to the sheet S using the ink jet method. Specifically, the recording unit 31 includes a carriage 32, a plate-shaped support plate 33 which is attached to the bottom face of the carriage 32, and a plurality of recording heads 34 which is attached to the bottom face of the support plate 33.

Figure 2:
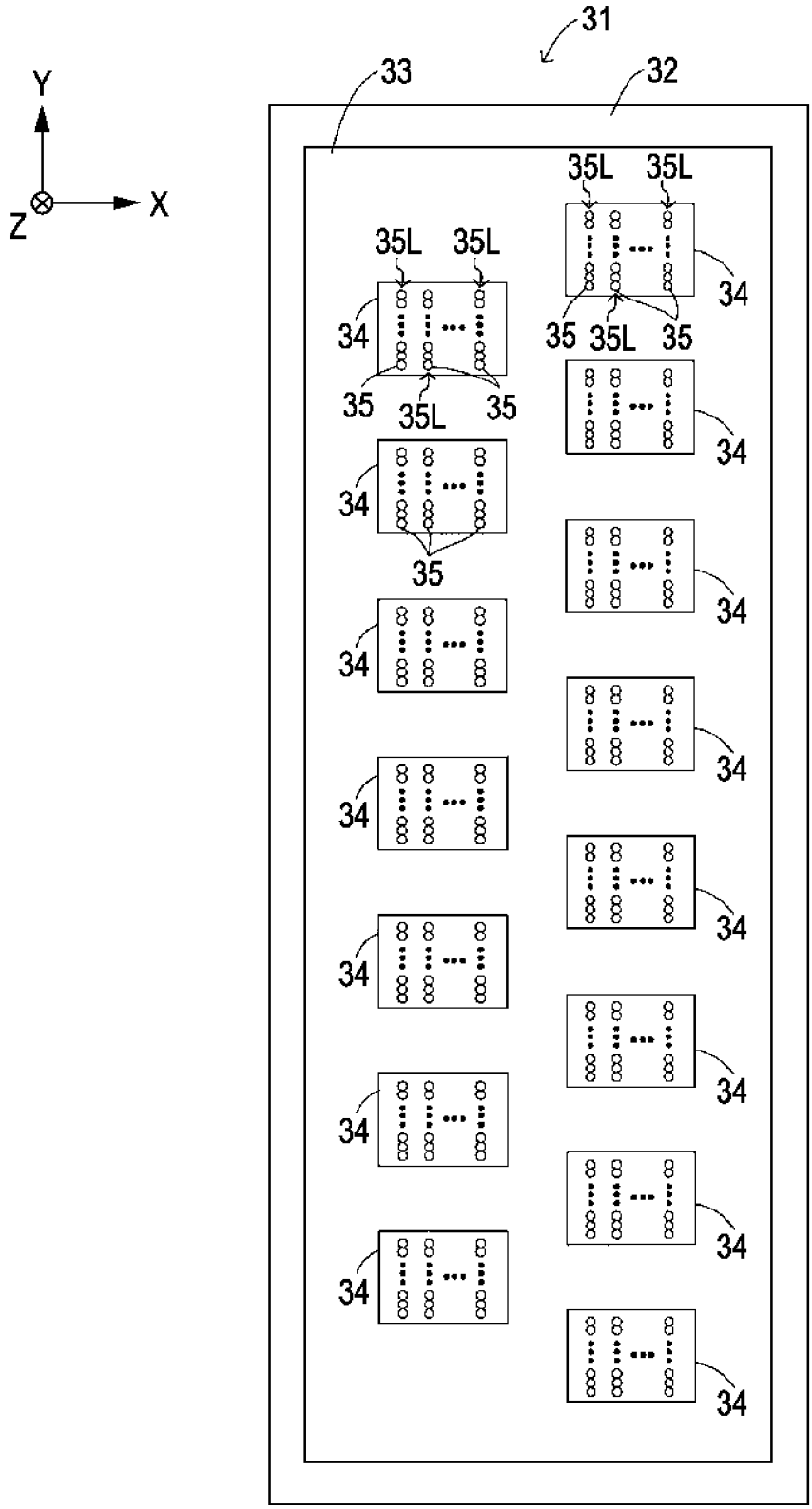
FIG. 2 is a plan view which partially shows a configuration of a recording unit.

FIG. 2 is a plan view which partially shows a configuration of a recording unit. As shown in FIG. 2, fifteen recording heads 34 are aligned in two rows in zigzag at the same pitch in the Y axis direction at the bottom face of the support plate 33. These recording heads 34 eject ink from nozzle 35, and have the same configuration as each other. Accordingly, hereinafter, one recording head 34 will be representatively described in detail for the configuration thereof.

At the bottom face of the recording head 34, the plurality of nozzles 35 (for example, 180) configures one nozzle column 35L by being linearly aligned at the same pitch in the Y axis direction, and the plurality of nozzle columns 35L are aligned in the X axis direction at the same pitch. The plurality of nozzle columns 35L which are aligned at the bottom face of the recording head 34 corresponds to ink colors which are different from each other, for example, when eight colors of ink are used, eight nozzle columns 35L are aligned at the bottom face of the recording head 34. In addition, nozzles 35 belonging to the same nozzle column 35L eject the same color ink as each other, on the other hand, nozzles 35 belonging to different nozzle column 35L eject color inks which are different from each other. In addition, the nozzle 35 uses a piezoelectric method in which ink is ejected to the outside of a tube by applying a voltage to a piezoelectric element attached to a fine tube in which ink is filled, and deforming the piezoelectric element.

Figure 3:
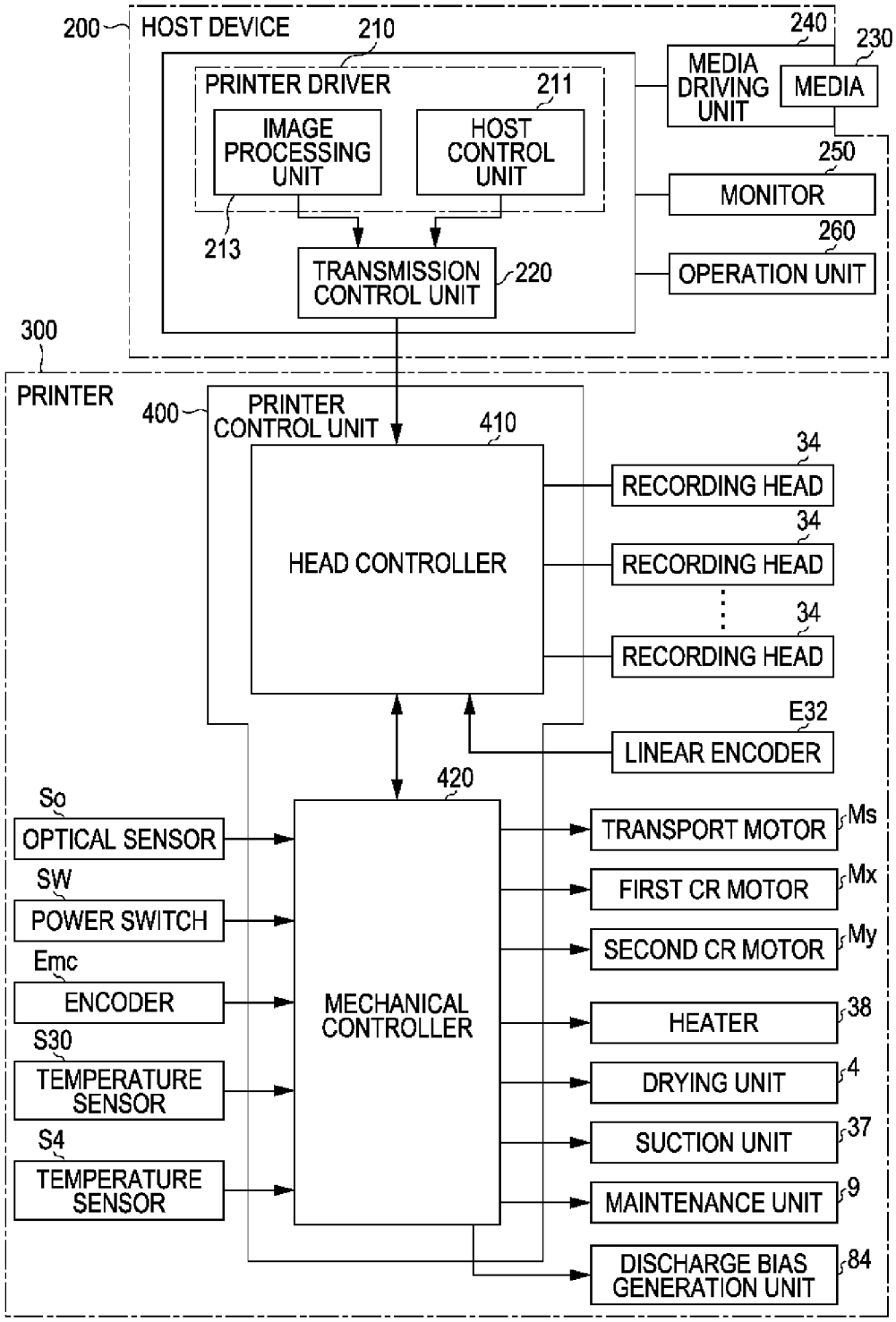
FIG. 3 is a block diagram which schematically shows an electrical configuration of the printing system in FIG. 1.

The description will be continued returning to FIG. 1. The carriage 32 of the recording unit 31 which is configured as described above is integrally movable along with the support plate 33 and the recording head 34. Specifically, a first guide rail 36 extending in the X axis direction is provided in the printing chamber 3, and the carriage 32 moves in the X axis direction along the first guide rail 36 when receiving a driving force of a first CR motor Mx (FIG. 3). In addition, a second guide rail (not shown) extending in the Y axis direction is provided in the printing chamber 3, and the carriage 32 moves in the Y axis direction along the second guide rail when receiving the driving force of a second CR motor My (FIG. 3).

In addition, printing is performed by moving the carriage 32 of the recording unit 31 two dimensionally in the XY plane with respect to the sheet S which is stopped on the top face of the platen 30. Specifically, the recording unit 31 performs an operation of ejecting ink onto the sheet S (main scanning) from each nozzle 35 of the recording head 34 while moving the carriage 32 in the X axis direction (main scanning direction). In the main scanning, a two dimensional image is printed in which an image of one line (line image) extending in the X axis direction which is formed by ink ejected by one nozzle is aligned in plural at intervals in the Y axis direction.

In addition, the plurality of main scannings is performed by alternately executing the main scanning and the sub-scanning in which the carriage 32 is moved in the Y axis direction (sub-scanning direction), (lateral scanning method).

That is, when one main scanning is ended, the recording unit 31 moves the carriage 32 in the Y axis direction by performing the sub-scanning. Subsequently, the recording unit 31 moves the carriage 32 in the X axis direction (the opposite orientation to the previous main scanning) from a position in which the carriage is moved by the sub-scanning.

In this manner, a line image by new main scanning is formed between each of the plurality of line images which is formed in advance by the previous main scanning. In addition, the main scanning and the sub-scanning are alternately performed. That is, in the printer 300, an image in which intermediate images are superimposed is formed, by performing a plurality of operations of forming the intermediate images which are formed from the plurality of line images (main scanning) while changing the position in the Y axis direction (sub-scanning) by ejecting ink from the nozzle 35 while moving the carriage 32 in the X axis direction.

In this manner, by performing the plurality of main scannings, one printing is performed. Here, one main scanning is referred to as a "pass", and one printing which is performed in the plurality of passes is referred to as a "frame". In addition, the intermediate image formed on the sheet S in one pass is referred to as "one pass image".

The reason why such a main scanning and the sub-scanning are alternately, and repeatedly performed is to improve the resolution. That is, by superimposing one pass image of M by performing M passes, it is possible to obtain one frame image having a resolution of M times of the one pass image. Therefore, the recording unit 31 performs printing of one frame by executing the number of passes corresponding to a resolution of an image to be printed.

Incidentally, the carriage 32 is able to reciprocate in the X axis direction. Therefore, the recording unit 31 is able to effectively perform the plurality of passes by executing movement of a going pass and a return pass of the carriage 32, respectively.

The printing of one frame as described above is repeatedly performed while intermittently moving the sheet S in the X axis direction. Specifically, almost the entire predetermined range of the top face of the platen 30 becomes the printing region. In addition, the sheet S is intermittently transported in the X axis direction in a unit of a distance (intermittent transport distance) corresponding to the length of the printing region in the X axis direction, and performs printing of one frame with respect to the sheet S which stops on the top face of the platen 30 in the middle of the intermittent transport. More specifically, when the printing of one frame on the sheet S stopping on the platen 30 is ended, the sheet S is transported in the X axis direction by the intermittent transport distance, and an unprinted surface of the sheet S is stopped on the platen 30. Subsequently, the printing of one frame is performed again on the unprinted surface, the sheet S is transported in the X axis direction again by the intermittent transport distance when the printing is ended. In addition, a series of these operations is repeatedly performed.

In addition, the platen 30 is provided with a mechanism which sucks the sheet S which is stopped on the top face thereof in order to keep the sheet S flat which is stopped on the top face of the platen 30 while being intermittently transported. Specifically, a plurality of suction holes which are not shown is open on the top face of the platen 30, and a suction unit 37 is attached to the bottom face of the platen 30. In addition, a negative pressure is generated in the suction holes on the top face of the platen 30, and the sheet S is sucked onto the top face of the platen 30, when the suction unit 37 is operated. In addition, the suction unit 37 keeps the sheet S flat by sucking the sheet S while the sheet S is stopped on the platen 30 for the printing, on the other hand, when the printing is ended, the suction unit stops the suction of the sheet S, and allows the sheet S to be smoothly transported.

In addition, a heater 38 is provided at the bottom face of the platen 30. The heater 38 heats the platen 30 to a predetermined temperature (for example, 45 degree). By doing that, the sheet S is subject to the printing processing by the recording head 34, and is primarily dried by the heat of the platen 30 at the same time. Further, drying of the ink landed on the sheet S is promoted by the primary drying.

In this manner, the sheet S which is subject to the printing of one frame, and to the primary drying on the top face of the platen 30 is moved along with the intermittent transport of the sheet S, and reaches the drying unit 4. The drying unit 4 performs drying processing in which ink landed on the sheet S is completely dried by air which is heated for drying. In addition, the sheet S which is subjected to the drying processing reaches the winding unit 5 along with the intermittent transport of the sheet S, and is wound as a roller R2.

In this manner, the sheet S is subject to the printing processing and the drying processing by the recording unit 31 and the drying unit 4. In addition, the printer 300 includes a functional unit such as a corona treatment machine 8, or a maintenance unit 9 in addition to the above described recording unit 31, or the drying unit 4. Subsequently, the detailed configuration and the operation of these will be described.

The corona treatment machine 8 is arranged on the upstream side of the sheet S in the transport direction with respect to the platen 30, and reforms the surface of the sheet S before entering the platen 30. Specifically, the corona treatment machine 8 includes a ground electrode roller 81 which winds the sheet S on the upstream side of the sheet S in the transport direction with respect to the roller 72, a corona discharge electrode 82 which faces the ground electrode roller 81 by nipping the sheet S, and an electrode cover 83 which covers the corona discharge electrode 82. The corona discharge electrode 82 is applied with a discharge bias from a discharge bias generation unit (FIG. 3), and causes the corona discharge between the corona discharge electrode and the ground electrode roller 81. Due to the corona discharge, the surface of the sheet S is reformed, and wettability of the sheet S with respect to ink is improved. In this manner, it is possible to increase fixability of the ink with respect to the sheet S in the printing processing by performing surface reforming of the sheet S prior to the printing processing.

The maintenance unit 9 is provided at a position separated from the platen 30 in the negative direction of the X axis, and performs the maintenance with respect to the recording head 34 which returns to a home position (position immediately above maintenance unit) when not printing. The maintenance unit 9 includes fifteen caps 91 which are provided one-to-one correspondence with respect to fifteen recording heads 34, and a lifting unit 93 which lifts the cap 91.

As maintenances performed by the maintenance unit 9, for example, there are capping, cleaning, and wiping. The capping is processing in which the cap 91 is lifted by the lifting unit 93, and covers the recording head 34 which is present at the home position with the cap 91. Due to the capping, it is possible to suppress the increase in viscosity of ink in the nozzle 35 included in the recording head 34. In addition, the cleaning is processing in which ink is forcibly ejected from the nozzle 35 by generating a negative pressure in the cap 91 in a state where the recording head 34 is capped. Due to the cleaning, it is possible to remove ink of which viscosity is increased, air bubbles in the ink, or the like from the nozzle 35. The wiping is processing in which a surface to which openings of the nozzles 35 are aligned in the recording head 34 (forming surface of nozzle opening) is wiped by a wiper which is not shown. Due to the wiping, it is possible to wipe out ink from the forming surface of the nozzle opening of the recording head 34.

Hitherto, the configuration of the units included in the printing system 100 has been summarized. Subsequently, an electrical configuration of the printing system in FIG. 1 will be described in detail by adding FIG. 3 to the above described FIG. 1. Here, FIG. 3 is a block diagram which schematically shows the electrical configuration included in the printing system in FIG. 1.

As described above, the printing system 100 includes a printer 300, and a host device 200 which controls the printer. The host device 200 is configured, for example, by a personal computer, includes a built-in printer driver 210 which controls operations of the printer 300, and a transmission control unit 220 which manages a communication function with the printer 300. In addition, the printer driver 210 is built when a CPU (Central Processing Unit) included in the host device 200 executes a program for the printer driver 210.

In addition, the host device 200 includes a media driving unit 240 which accesses media 230 in which the program for the printer driver is stored, and which reads out the program. As the media 230, it is possible to use a variety of media such as a CD (Compact Disc), a DVD (Digital Versatile Disc), and a USB (Universal Serial Bus) memory.

Further, the host device 200 includes a monitor 250 which is configured by a liquid crystal display or the like, as an interface with a worker, and an operation unit 260 which is configured by a keyboard, a mouse, or the like. In addition, the operation unit 260 may be configured by a touch panel of the monitor 250, using a touch panel-type display as the monitor 250. A menu-screen is displayed on the monitor 250, in addition to an image as a printing target. Accordingly, it is possible for a worker to set a variety of printing conditions, such as a type of a printing medium, a size of the printing medium, an image quality, and the number of prints by opening a printing set screen from a menu screen, by operating the operation unit 260 while checking the monitor 250.

The type of the printing medium (that is, sheet S) is generally classified into a paper-based medium and a film-based medium. More specifically, as the paper-based medium, there are fine quality paper, cast paper, art paper, coated paper, or the like, and as the film-based medium, there are synthetic paper, PET (Polyethylene terephthalate), PP(polypropylene), or the like. As a size of the printing medium, the width of the sheet S (width in the Y axis direction) is set. The printing quality may be set by selecting one printing mode from a plurality of printing modes which is prepared according to the resolution to be printed. For example, it is as follows. That is, in the above described printer 300, it is possible to change the resolution by changing the number of passes executed in one frame. Therefore, it may be configured such that a plurality of printing modes is prepared in which the number of passes executed in one frame is different from each other, and a printing mode with the number of passes corresponding to the resolution to be printed is selectable. In this manner, it is possible to execute printing with a resolution corresponding to the number of passes of the selected printing mode. In addition, it may be configured such that the printing quality is set by directly inputting the resolution instead of the printing mode. The number of prints is set when overlappingly printing a plurality of prints (images) in the same area on the printing medium, and specifically, the number of prints to be overlappingly printed is set. Incidentally, when a plurality of prints is set, it is possible to display an image of each print on the monitor 250.

In addition, the printer driver 210 includes a host control unit 211 which controls a display of the monitor 250, or input processing from the operation unit 260. That is, the host control unit 211 displays a variety of screens such as a menu screen, or a print setting screen on the monitor 250, and performs processing corresponding to input contents from the operation unit 260 in the variety of screens. In this manner, the host control unit 211 generates necessary control signals for controlling the printer 300 according to an input from a worker.

In addition, the printer driver 210 includes an image processing unit 213 which performs image processing with respect to image data received from an external device, and generates printing data. Specifically, image processing such as resolution conversion processing, color conversion processing, and half-toning are executed.

In addition, a control signal generated in the host control unit 211, printing data generated in the image processing unit 213 are transmitted to a printer control unit 400 which is provided in the main body case 1 of the printer 300 through a transmission control unit 220. The transmission control unit 220 is able to perform bidirectional serial communication with the printer control unit 400, transmits the control signal, or the printing data to the printer control unit 400, receives an answer signal thereof from the printer control unit 400, and transmits the answer signal to the host control unit 211.

The printer control unit 400 includes a head controller 410 and a mechanical controller 420. The head controller 410 has a function of controlling the recording head 34 on the basis of the printing data transmitted from the printer driver 210. Specifically, the head controller 410 controls ejecting of ink from the nozzle 35 of the recording head 34 on the basis of the printing data. At this time, the timing of ejecting ink from the nozzle 35 is controlled on the basis of the movement of the carriage 32 in the X axis direction. That is, a linear encoder E32 which detects the position of the carriage 32 in the X axis direction is provided in the printing chamber 3. In addition, the head controller 410 ejects ink from the nozzle 35 at a timing corresponding to the movement of the carriage 32 in the X axis direction by referring to an output of the linear encoder E32.

On the other hand, the mechanical controller 420 mainly has a function of controlling the intermittent transport of the sheet S, and a driving of the carriage 32. Specifically, the mechanical controller 420 controls a transport motor Ms which drives a sheet transport system configured by the feeding unit 2, the rollers 71 to 77, and the winding unit 5 on the basis of an output of an encoder Emc which detects a rotation of the transport motor Ms, and executes the intermittent transport of the sheet S. In addition, the mechanical controller 420 causes the carriage 32 to execute the movement in the X axis direction for the main scanning by controlling the first CR motor Mx, and also causes the carriage 32 to execute the movement in the Y axis direction for the sub-scanning by controlling the second CR motor Mx.

In addition, it is possible to execute printing of one frame with respect to the sheet S which is intermittently transported by performing the number of passes corresponding to a resolution, when the head controller 410 and the mechanical controller 420 appropriately control these while being synchronized with each other.

In addition, the mechanical controller 420 is able to execute a variety of controls in addition to the above control for the printing processing. Specifically, the mechanical controller 420 executes starting processing of each unit of the printer 300 when a power switch SW is on-state, by detecting on and off of the power switch SW. In addition, the mechanical controller 420 executes a temperature control, for example, of performing a feedback control of the heater 38 on the basis of an output of a temperature sensor S30 which detects a temperature on the top face of the platen 30, or performing a feedback control of the drying unit 4 on the basis of an output of a temperature sensor S4 which detects a temperature in the drying unit 4. Further, the mechanical controller 420 is able to execute each operation such as adjusting of a negative pressure generated in the suction hole of the platen 30 by controlling the suction unit 37, executing a predetermined maintenance by controlling the maintenance unit 9, or adjusting a value of the discharge bias by controlling a discharge bias generation unit 84.

Figure 4:
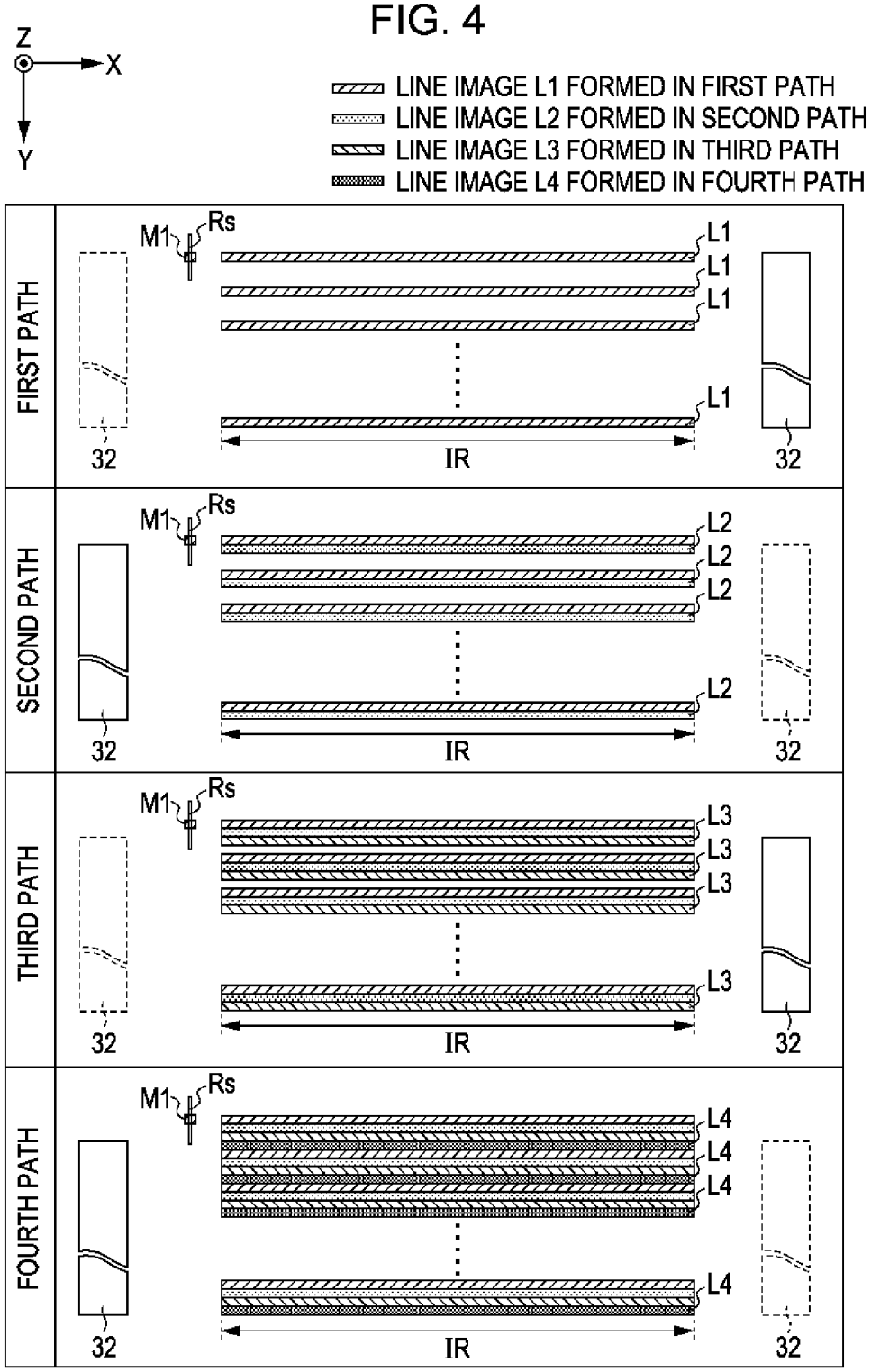
FIG. 4 is a schematic diagram of a printing operation in a first embodiment.

Hitherto, the electrical configuration of the printing system in FIG. 1 has been summarized. Subsequently, detailed printing operation which is executed in the first embodiment will be described using FIG. 4. FIG. 4 is a diagram which schematically shows the printing operation in the first embodiment. In the example in the figure, an operation in which an image of one frame is printed in four passes in an effective print area IR including a predetermined width in the X axis direction. In addition, the carriages 32 which are shown by dashed lines in each column of the "first pass" to "fourth pass" denote the carriage 32 at the starting point of the pass, and the carriages 32 shown by solid lines denote the carriage 32 at the ending point of the pass. As shown in the figure, an image of one frame is printed by causing the carriage 32 to reciprocate twice (integrally with the recording head 34) between the outer side in the negative direction of the X axis and the outer side in the positive direction of the X axis of the effective print area IR, and by performing four passes.

As shown in the column of the "first pass" in the figure, the carriage 32 passes through the upper side of the effective print area IR of the sheet S in the positive direction of the X axis, and liquid (ink) is ejected from each nozzle 35 of the recording head 34, at the same time. In this manner, a plurality of line images L1 is aligned in the Y axis direction with a gap on the sheet S. When the main scanning of the first pass is ended in this manner, the sub-scanning is performed, and the carriage 32 moves in the positive direction of the Y axis by the movement distance Y32.

When the sub-scanning is ended, as shown in the column of the "second pass" in the figure, the carriage 32 passes through the upper side of the effective print area IR of the sheet S in the negative direction of the X axis, and the liquid is ejected from each nozzle 35 of the recording head 34, at the same time. In this manner, one line of new line images L2 are formed between the respective plurality of line images L1 which is formed in the first pass. When the main scanning of the second pass is ended in this manner, the sub-scanning is performed, and the carriage 32 moves in the positive direction of the Y axis by the movement distance Y32. Subsequently, the "third pass" and the "fourth pass" are performed in the same manner as those of the "first pass" and the "second pass", and an image of one frame is printed in the effective print area IR.

By performing four passes like this, four line images of L1 to L4 are formed in the Y axis direction by being adjacent to each other by one nozzle 35. In addition, when the plurality of nozzles 35 respectively perform the operation, the line images L1 to L4 are formed by being aligned in the Y axis direction repeatedly. In this manner, an image of one frame with a resolution four times that of a one pass image is printed.

Meanwhile, regarding the movement distance Y32 which moves the carriage 32 in the sub-scanning, the initial set value $\alpha$ thereof is stored in a memory which is built into the mechanical controller 420 (not shown). However, in the embodiment, the correction value $\Delta\alpha$ is obtained on the basis of a result in which a displacement of the mark formed on the sheet S is detected, and a value in which the correction value $\Delta\alpha$ is added to the initial set value $\alpha$ is set as the movement distance Y32. That is, the printing operation is executed while appropriately correcting the movement distance Y32 of the carriage 32 in the sub-scanning. Hereinafter, the correction operation of the movement distance Y32 will be described in detail.

In the initial pass among the four passes configuring one frame (that is, the first pass), the mark M1 is formed on the sheet S before forming the line image L1. That is, when the carriage 32 starts to move in the positive direction of the X axis in order to execute the first pass, liquid is ejected from the nozzle 35 of the recording head 34, and the mark M1 is formed at the outer side in the negative direction of the X axis of the effective print area IR. In addition, the line image L1 is formed in the effective print area IR, after forming the mark M1. In addition, forming of the mark M1 is performed by the nozzle 35 in the most upstream side in the Y axis direction among the plurality of nozzles 35 included in the carriage 32. Accordingly, the mark M1 is formed on the upstream end side in the Y axis direction.

The mark M1 formed in this manner is detected by an optical sensor So. That is, the optical sensor So is arranged at the outer side of the effective print area IR in the negative direction of the X axis by facing the top face of the platen 30. The optical sensor So is a line sensor which is supported by the main body case 1 in a state where the position thereof with respect to the platen 30 is fixed. Specifically, the optical sensor So is positioned so that the longitudinal direction of the detection area Rs thereof becomes parallel to the Y axis direction, and a target to be detected (here, the mark M1) in the detection area Rs is detected. In addition, the optical sensor So transmits information related to a position of the target to be detected in the Y axis direction to the mechanical controller 420. In this manner, the mechanical controller 420 is able to monitor the displacement of the mark M1 which is formed on the sheet S in the Y axis direction.

In addition, the mechanical controller 420 obtains the correction value $\Delta\alpha$ of the movement distance Y32 of the carriage 32 in each sub-scanning, on the basis of the displacement of the mark M1 in the Y axis direction which is detected in this manner. That is, the displacement of the mark M1 in the Y axis direction reflects the stretching of the sheet S in the Y axis direction. Therefore, the mechanical controller 420 executes the printing of one frame according to the stretching of the sheet S in the Y axis direction while adjusting the movement distance Y32 of the carriage 32 in the Y axis direction in each sub-scanning.

Specifically, when the mark M1 is formed in the first pass, the mechanical controller 420 stores the initial position of the mark M1 (position of mark M1 at the time of forming the mark M1). Subsequently, when forming of the line image L1 in the first pass is ended, the mechanical controller 420 compares the position of the mark M1 at this time to the initial position, obtains the displacement of the mark M1 generated by the formation of the line image L1, and determines the correction value $\Delta\alpha$ according to the displacement. Specifically, for example, when the displacement of the mark M1 is 50 μm, the correction value $\Delta\alpha$ is set to 50 μm. In addition, a value in which the correction value $\Delta\alpha$ is added to the initial set value is set as the movement distance Y32 of the carriage 32 in the sub-scanning which is performed between the first pass and the second pass. In this manner, the carriage 32 moves in the Y axis direction by the movement distance Y32 ($=\alpha+\Delta\alpha$) in the sub-scanning.

Incidentally, when the displacement of the mark M1 at the time of ending the formation of the line image L1 is minimum, the initial set value is set as the movement distance Y32 of the carriage 32 in the sub-scanning which is performed between the first pass and the second pass as is. In addition, in the sub-scanning, the carriage 32 moves in the Y axis direction by the movement distance Y32 ($=\alpha$). Further, even in the setting operation of the movement distance Y32 shown hereinafter, when the displacement of the mark is small, the initial set value is set as the movement distance Y32 of the carriage 32 in the sub-scanning as is.

In this manner, when the sub-scanning after the first pass is performed, subsequently the second pass is performed. When the formation of the line image L2 is ended in the second pass, the mechanical controller 420 obtains the displacement of the mark M1 at this time from the initial position. In addition, as described above, the movement distance Y32 of the carriage 32 in the sub-scanning which is performed between the second and third passes is adjusted on the basis of the displacement of the mark M1 at the time of ending the formation of the line image L2.

When the sub-scanning in the second pass is ended, subsequently, the third pass is performed. When the formation of the line image L3 is ended in the third pass, the mechanical controller 420 obtains the displacement of the mark M1 at this time from the initial position. In addition, as described above, the movement distance Y32 of the carriage 32 in the sub-scanning which is performed between the third and fourth passes is adjusted on the basis of the displacement of the mark M1 at the time of ending the formation of the line image L3. Subsequently, the fourth pass is performed after performing the sub-scanning between the third pass and the fourth pass, and printing of one frame is ended.

In addition, in the example shown here, the displacement of the mark M1 is set to the correction value $\Delta\alpha$ as is, however, a method of converting the displacement of the mark M1 to the correction value $\Delta\alpha$ is not limited to this, and a variety of modifications can be made. As a specific example, it is preferable that each pass is performed in a state where the movement distance of the carriage 32 in each sub-scanning is fixed to the initial set value $\alpha$, the position shift of the line images L1 to L4 in the Y axis direction at this time is measured, and the positional relationship between the amount of the position shift of the line images L1 to L4 in the Y axis direction and the displacement of the mark M1 is obtained from the measurement result, and the correlation is stored in the mechanical controller 420 in advance. In addition, it is preferable that, when performing the printing, the position shift of the line images L1 to L4 in the Y axis direction is predicted from the displacement of the mark M1 on the basis of the positional relationship, and the correction value $\Delta\alpha$ is determined so as to cancel out the predicted value.

In the embodiment which is configured as above, the main scanning in which the line images L1 to L4 are formed by ejecting liquid from the recording head 34 while moving the recording head 34 in the X axis direction (main scanning direction), and the sub-scanning in which the recording head 34 is moved in the Y axis direction (sub-scanning direction) are alternately performed. In this manner, the plurality of main scannings is performed, and the line images L1 to L4 adjacent to each other in the Y axis direction are formed in different main scannings (passes) from each other. For this reason, the line images L1 to L4 which are formed by the main scannings (passes) performed at a different timing are aligned adjacent to each other in the Y axis direction. In addition, in such a configuration, when the sheet S is stretched in the Y axis direction, there was a concern that the above described gap may occur.

In the embodiment, the positions of forming the line images L2 to L4 are adjusted in the Y axis direction in order to solve such a problem. That is, in the embodiment with the above described configuration, the positions of the line images L2 to L4 adjusted in the Y axis direction can be adjusted by changing the position of the recording head 34 which performs the main scanning in order to form the line images L2 to L4 in the Y axis direction. Specifically, it is possible to adjust the position of the line images L2 to L4 in the Y axis direction by changing the position of the recording head 34 in the Y axis direction during main scanning performed subsequent to the sub-scanning, by adjusting the movement distance Y32 which moves the recording head 34 in the Y axis direction in the sub-scanning. Accordingly, if it is possible to adjust the movement distance Y32 which moves the recording head 34 in the sub-scanning according to the stretching of the sheet S in the Y axis direction, it is possible to suppress the occurrence of the above described gap. Accordingly, the embodiment has a configuration in which the displacement of the mark M1 which is formed on the sheet S in the Y axis direction is detected. In addition, the movement distance Y32 which moves the recording head 34 during sub-scanning is adjusted on the basis of the detection result. As a result, it is possible to suppress the occurrence of the above described gap.

In addition, in the embodiment, the mark M1 is formed on the sheet S when the recoding head 34 ejects liquid on the sheet S. With such a configuration, there is an advantage that timing or position of forming the mark M1 can be appropriately adjusted.

In addition, in the embodiment, the mark M1 is formed on the sheet S when the recording head 34 which moves in the X axis direction while performing the main scanning ejects liquid on the sheet S. With such a configuration, there is an advantage that the printing speed is improved without separately performing the operation for forming the mark M1, since it is possible to form the mark M1 while performing the main scanning.

Meanwhile, in the above described configuration in which the line images L1 to L4 are formed by ejecting liquid on the sheet S, the sheet S tends to be stretched in the Y axis direction, since the amount of the liquid attached to the sheet S increases every time forming the line images L1 to L4. In this case, such a stretching on the sheet S which occurs due to the formation of the line images L1 to L4 can be preferably reflected in the displacement of the mark M1.

Therefore, in the embodiment, during main scanning of the first pass in which the mark M1 is formed, the line image L1 is formed after forming the mark M1. Accordingly, the stretching of the sheet S occurs when forming the line image L1 can be reflected in the displacement of the mark M1. As a result, it is possible to further reliably suppress the occurrence of the above described gap.

In addition, in the embodiment, the mark M1 is formed while performing the first main scanning (first pass) among the plurality of main scanning (four pass). With such a configuration, it is possible to reflect the stretching on the sheet S which occurs when forming the line images L1 to L4 in each main scanning in the displacement of the mark M1. As a result, it is possible to further reliably suppress the occurrence of the above described gap.

In addition, in the embodiment, the optical sensor So has a line sensor in which the longitudinal direction of the detection area Rs is arranged in parallel to the X axis direction, and the displacement of the mark M1 in the Y axis direction is detected on the basis of the result which is detected by the line sensor. By using such a line sensor, it is possible to reliably grasp the displacement of the mark M1 in the Y axis direction.

In addition, as described above, as the sheet S, both the paper-based medium and the film-based medium can be used. Further, the paper-based medium can be easily stretched due to moisture such as liquid ejected from the recording head 34, and as a result, there is a concern that the above described gap may occur. Therefore, it is preferable to suppress the occurrence of the gap with such a configuration of the embodiment. In addition, the film-based medium is easily stretched due to temperature. Particularly, in a configuration in which the sheet S is heated by the platen 30, there is a concern that the stretching due to the temperature becomes significant. Therefore, it is preferable to suppress the occurrence of the gap with such a configuration of the embodiment.

Second Embodiment

Meanwhile, there is a case where a stretching of the sheet S is different according to the position in the Y axis direction. Therefore, in a second embodiment to be described hereinafter, a plurality of marks M1 is formed in a different position from each other in the Y axis direction, and due to this, the difference in the stretching of the sheet S in different positions in the Y axis direction can be detected by a displacement of the mark M1. In addition, a difference between the first embodiment and the second embodiment is mainly in the formation aspect of the mark, accordingly, hereinafter, the difference will be mainly described, and descriptions about common portions will be appropriately omitted. However, since the second embodiment has a configuration common with the first embodiment, it is needless to say that the same effect will be attained even in the second embodiment. In addition, the same will be applied to a third to sixth embodiments which are described subsequently to the second embodiment.

Figure 5:
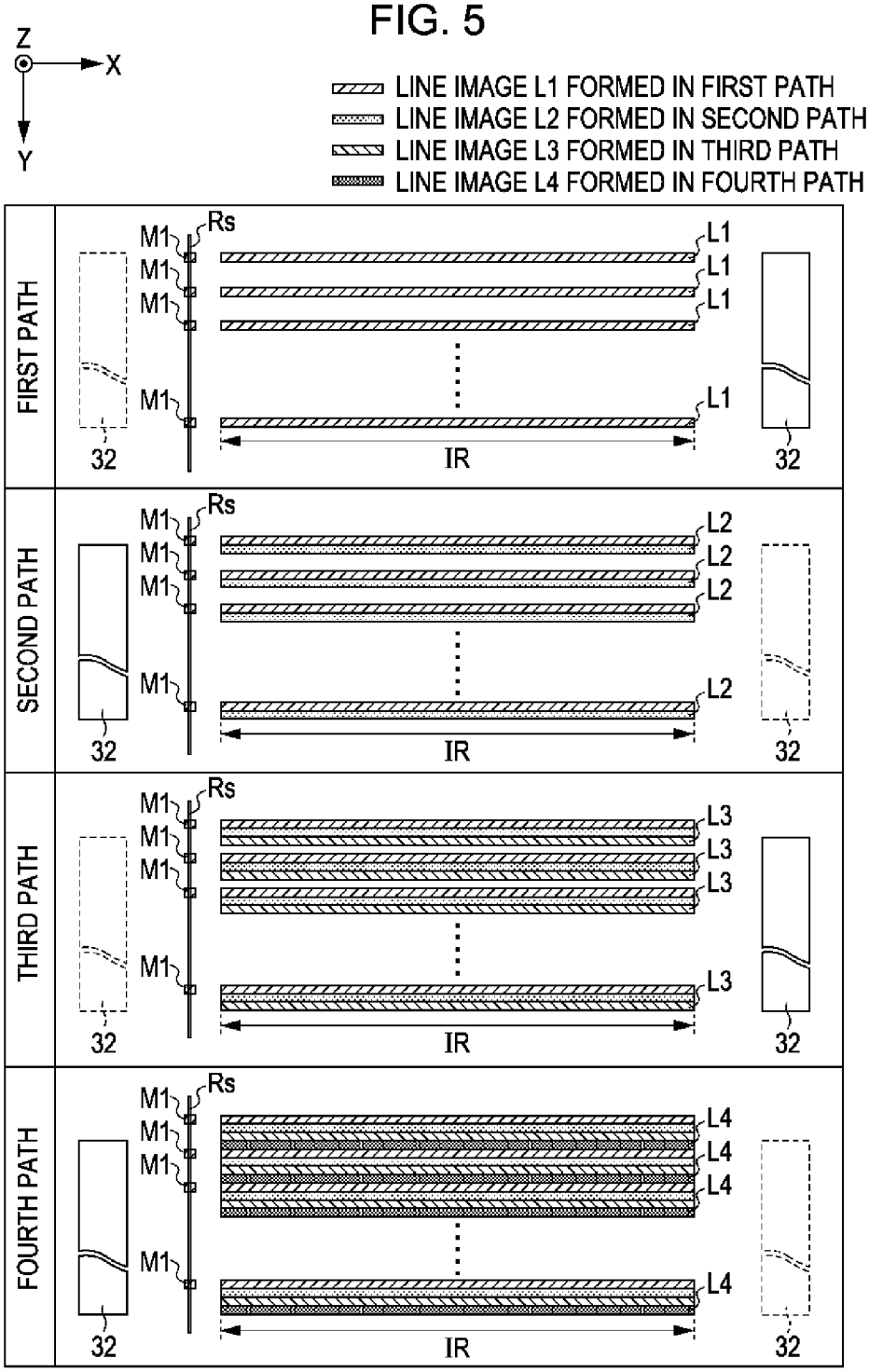
FIG. 5 is a schematic diagram of a printing operation in a second embodiment.

FIG. 5 is a diagram which schematically shows a printing operation in the second embodiment. Even in the example in FIG. 5, similarly to FIG. 4, an image of one frame is printed by causing a carriage 32 (integrally with a recording head 34 to reciprocate twice between the outer side in the negative direction of the X axis and the outer side in the positive direction of the X axis of the effective print area IR, and to perform four passes. In addition, references relating to the carriage 32 in FIG. 5 (solid line and dashed line) have the same meaning as those in FIG. 4.

Even in the second embodiment, in the initial pass among four passes configuring one frame (that is, the first pass), a mark M1 is formed on the sheet S before forming a line image L1. However, differently from the first embodiment, each of the plurality of the nozzles 35 provided in the carriage 32 forms each of the marks M1. In this manner, the plurality of marks M1 is formed at different positions from each other in the Y axis direction.

In addition, in the second embodiment, detection areas Rs of an optical sensor So (line sensor) are provided in the entire region where the plurality of marks M1 is aligned, and information relating to the respective positions of the plurality of marks M1 is transmitted to a mechanical controller 420 from the optical sensor So. In addition, the mechanical controller 420 obtains the correction value $\Delta\alpha$ of a movement distance of the carriage 32 in each sub-scanning.

That is, when the plurality of marks M1 is formed in the first pass, the mechanical controller 420 stores the initial position of each mark M1 (position of each mark M1 at the time of formation). Subsequently, when a formation of the line image L1 in the first pass is ended, the mechanical controller 420 obtains a displacement of each mark M1 from the initial position at this time. Further, the mechanical controller 420 calculates the mean value of the displacement of the plurality of marks M1 which has obtained in this manner, and determines the correction value $\Delta\alpha$ according to the mean value. In addition, a value in which the correction value $\Delta\alpha$ is added to the initial set value $\alpha$ is set as the movement distance Y32 of the carriage 32 in the sub-scanning which is performed between the first pass and the second pass. In this manner, in the sub-scanning, the carriage 32 moves in the Y axis direction by the movement distance Y32 ($=\alpha+\Delta\alpha$).

In addition, a detailed method of converting the mean value of the displacement of the mark M1 to the correction value $\Delta\alpha$ is the same as the method of converting the displacement of the mark M1 to the correction value $\Delta\alpha$ described in the first embodiment. That is, it is preferable to use the mean value of the displacement of the mark M1 instead of the displacement of the mark M1 in the first embodiment.

In this manner, when the sub-scanning after the first pass is performed, then the second pass is performed, subsequently. When the formation of the line image L2 is ended in this second pass, the mechanical controller 420 obtains a displacement at this time from the initial position of each mark M1. In addition, as in the above description, the movement distance Y32 of the carriage 32 in the sub-scanning which is performed between the second pass and the third pass is adjusted on the basis of the mean value of the displacement of each mark M1 at the time of ending of formation of the line image L2.

When the sub-scanning after the second pass is performed, then the third pass is performed, subsequently. When the formation of the line image L3 is ended in this third pass, the mechanical controller 420 obtains a displacement at this time from the initial position of each mark M1. In addition, as in the above description, the movement distance Y32 of the carriage 32 in the sub-scanning which is performed between the third pass and the fourth pass is adjusted on the basis of the mean value of the displacement of each mark M1 at the time of ending of formation of the line image L3. Subsequently, after performing the sub-scanning between the third pass and the fourth pass, the fourth pass is performed, thereby completing printing of one frame.

As described above, even the second embodiment has the configuration of detecting the displacement of the mark M1 which is formed on the sheet S in the Y axis direction. In addition, the movement distance Y32 which moves the recording head 34 in the Y axis direction in the sub-scanning is adjusted on the basis of the detection result. As a result, it is possible to suppress the occurrence of the above described gap.

In addition, in the second embodiment, the plurality of marks M1 is formed in different position from each other in the Y axis direction. Due to this, the differences in stretching of the sheet S in different positions in the Y axis direction are detected by the displacement of the mark M1. As a result, it is possible to further reliably suppress the occurrence of the above described gap.

In addition, in the example shown in the second embodiment, all of the nozzles 35 included in the carriage 32 form the mark M1. However, it is also possible that only a part of the nozzles 35 (for example, every other nozzle 35, or every third nozzle 35 in the Y axis direction) forms the mark M1, and the plurality of marks M1 is formed in different position in the Y axis direction.

Third Embodiment

Meanwhile, as shown in the second embodiment, there is a case where occurrence aspects of the above described gap are different in the positive direction and the negative direction of the Y axis on the sheet S due to the fact that the stretching of the sheet S is different depending on the position in the Y axis direction. It will be described in detail as follows.

That is, the expansion of the sheet S occurs as if both ends in the Y axis direction are expanded with the center portion in the Y axis direction as the center. Accordingly, the positive direction of the Y axis of the sheet S is further expanded in the positive direction, and moves, and the negative direction of the Y axis of the sheet S is further expanded in the negative direction, and moves. The recording head 34 performs ejecting of ink in each destination (main scanning) while moving in the positive direction from the negative direction of the Y axis (sub-scanning) with respect to the sheet S which is stretched in this manner. Accordingly, the movement direction of the recording head 34 accompanying the sub-scanning is backward with respect to the direction in which the sheet S is expanded in the half negative direction of the Y axis. On the other hand, the movement direction of the recording head is forward with respect to the direction in which the sheet S is expanded in the half positive direction of the Y axis. As a result, there was a case where the occurrence of the above described gap is particularly significant in the half negative direction of the Y axis of the sheet S in which the recording head 34 moves backward with respect to the direction in which the sheet S is stretched.

Therefore, the second embodiment may be modified as follows. That is, in the second embodiment, the correction value $\Delta\alpha$ was determined according to the mean value of the displacement of the plurality of the marks M1. At this time, the correction value $\Delta\alpha$ may be determined from the mean value which is obtained from a weighted mean. More specifically, the weighted mean of the displacement of the plurality of marks M1 is obtained by weighing the larger magnitude than the displacement of the mark M1 which is formed in the half positive direction of the Y axis of the sheet S with respect to the displacement of the mark M1 which is formed in the half negative direction of the Y axis of the sheet S. In addition, the movement distance Y32 of the carriage 32 in the sub-scanning is corrected from the initial set value $\alpha$ by the correction value $\Delta\alpha$ which is determined on the basis of the weighted mean. In this manner, it is possible to effectively suppress the occurrence of the gap which is particularly significant in the half negative direction of the Y axis of the sheet S.

Fourth Embodiment

Figure 6:
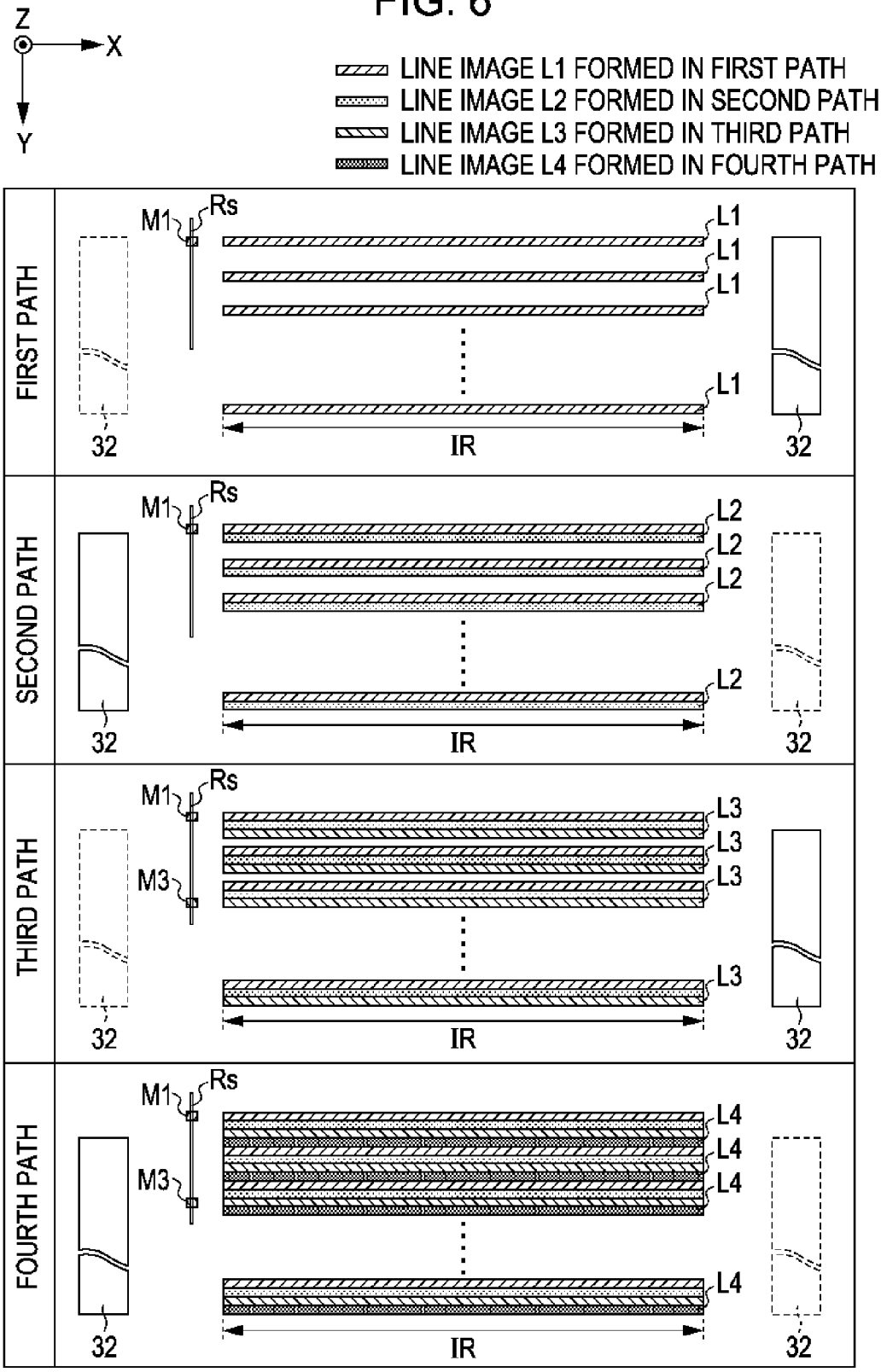
FIG. 6 is a schematic diagram of a printing operation in a fourth embodiment.

FIG. 6 is a diagram which schematically shows a printing operation in a fourth embodiment. Even in the example in FIG. 6, an image of one frame is printed by causing a carriage 32 (integrally with a recording head 34) to reciprocate twice between the outer side in the negative direction of the X axis and the outer side in the positive direction of the X axis of the effective print area IR, and to perform four passes. However, in the fourth embodiment, marks M1 and M3 are formed before forming line images L1 and L3 in each of the first pass and third pass. In addition, references relating to the carriage 32 in FIG. 6 (solid line and dashed line) have the same meaning as those in FIG. 4.

Since operations in the first and the second passes in the fourth embodiment are the same as those in the first embodiment, descriptions thereof are omitted, and operations of the third pass and thereof will be mainly described. As described above, in the fourth embodiment, the mark M3 is formed before forming the line image L3 in the third pass. At this time, a mechanical controller 420 stores the initial position of the mark M3 (position of the mark M3 at the time of formation) when the mark M3 is formed in the third pass. Subsequently, when the formation of the line image L3 in the third pass is ended, the mechanical controller 420 obtains the displacement of the mark M3 at this time from the initial position. In addition, the movement distance Y32 of the carriage 32 in the sub-scanning which is performed between the third and the fourth passes is adjusted on the basis of the displacement of the mark M3 at the time of completing the formation of the line image L3. Subsequently, the fourth pass is performed after performing the sub-scanning between the third pass and the fourth pass, and the printing of one frame is completed.

As described above, even the fourth embodiment has the configuration of detecting the displacement of the marks M1 and M3 which are formed on the sheet S in the Y axis direction. In addition, the movement distance Y32 which moves the recording head 34 in the Y axis direction in the sub-scanning is adjusted on the basis of the detection result. As a result, it is possible to suppress the occurrence of the above described gap.

Fifth Embodiment

Figure 7:
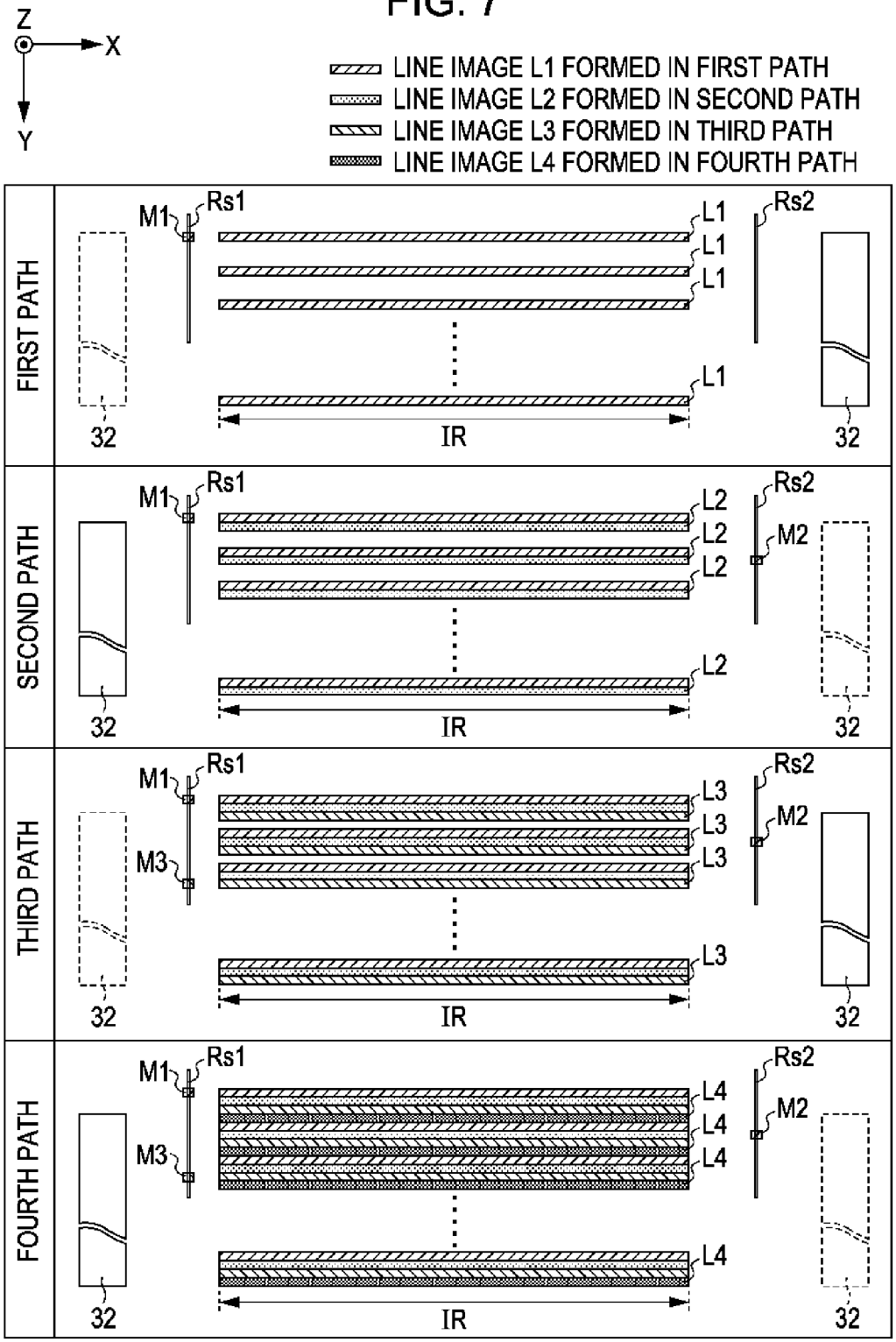
FIG. 7 is a schematic diagram of a printing operation in a fifth embodiment.

FIG. 7 is a diagram which schematically shows a printing operation in a fifth embodiment. Even in the example in FIG. 7, an image of one frame is printed by causing a carriage 32 (integrally with a recording head 34) to reciprocate twice between the outer side in the negative direction of the X axis and the outer side in the positive direction of the X axis of the effective print area IR, and to perform four passes. In addition, references relating to the carriage 32 in FIG. 7 (solid line and dashed line) have the same meaning as those in FIG. 4.

In the fifth embodiment, marks M1 to m3 are formed on a sheet S before forming line images L1 to L3, in a first to third passes among four passes configuring one frame. In this manner, the marks M1 and M3 are formed on the outer side of the effective print area IR in the negative direction of the X axis, on the other hand, a mark M2 is formed on the outer side of the effective print area IR in the positive direction of the X axis. In addition, an optical sensor So (line sensor) is arranged on both outer sides of the effective print area IR in the X axis direction corresponding to formation positions of such marks M1 to M3, and detection areas Rs1 and Rs2 of each of the optical sensors So are also located thereto. In this manner, the marks M1 and M3 are detected in the detection are Rs1, and position information of each mark M1 and M3 is output to the mechanical controller 420. In addition, the mark M2 is detected in the detection area Rs2, and the position information of each mark M2 is output to the mechanical controller 420.

In the fifth embodiment with such a configuration, a movement distance Y32 of the carriage 32 in the sub-scanning which is performed between an nth pass and (n+1)th pass in the sub-scanning is determined on the basis of a displacement of a mark Mn which is formed in the nth pass. Here, n is a positive integer, and the mark which is formed in the nth pass is denoted by Mn. In addition, in the embodiment, a line image which is formed in the nth pass is appropriately denoted by Ln.

That is, when the mark Mn is formed in the nth pass, the mechanical controller 420 stores the initial position of the mark Mn (position of the mark Mn at the time of formation). Subsequently, when the formation of the line image Ln in the nth pass is ended, the mechanical controller 420 obtains a displacement of the mark Mn at this time from the initial position. In addition, the mechanical controller 420 determines a correction value $\Delta\alpha$ from the displacement of the mark Mn obtained in this manner. Further, a value in which the correction value $\Delta\alpha$ is added to the initial set value $\alpha$ is set as the movement distance Y32 of the carriage 32 in the sub-scanning which is performed between the nth pass and the (n+1)th pass. In this manner, in the sub-scanning, the carriage 32 moves in the Y axis direction by the movement distance Y32 ($=\alpha+\Delta\alpha$). In addition, such an operation is performed in the first to third passes, then the fourth pass is performed, thereby completing the printing of one frame.

As described above, even the fifth embodiment has the configuration of detecting the displacement of the mark Mn which is formed on the sheet S in the Y axis direction. In addition, the movement distance Y32 which moves the recording head 34 in the Y axis direction in the sub-scanning is adjusted on the basis of the detection result. As a result, it is possible to suppress the occurrence of the above described gap.

Sixth Embodiment

Figure 8:
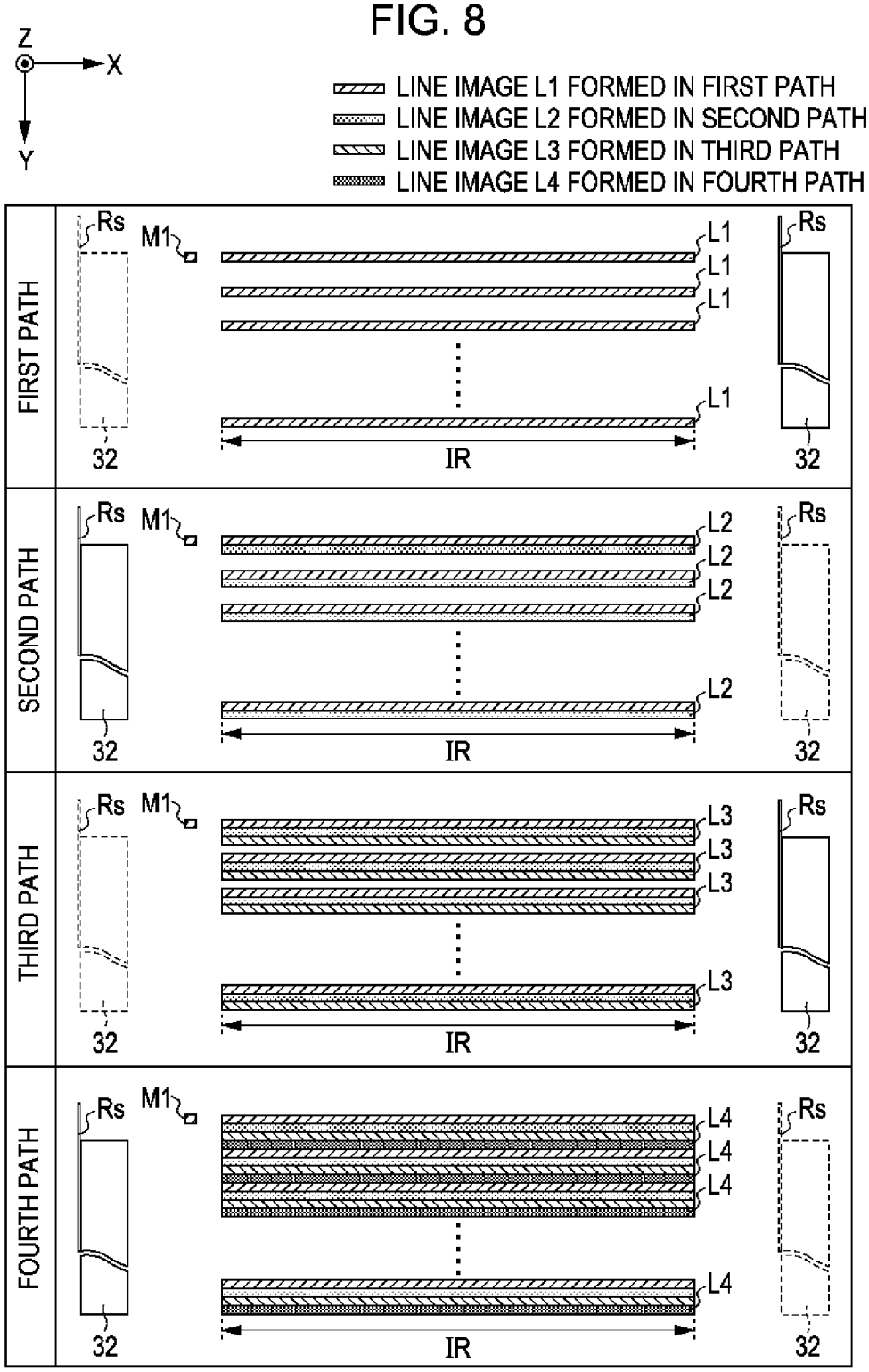
FIG. 8 is a schematic diagram of a printing operation in a sixth embodiment.

FIG. 8 is a diagram which schematically shows a printing operation in a sixth embodiment. Even in the example in FIG. 8, an image of one frame is printed by causing a carriage 32 (integrally with a recording head 34) to reciprocate twice between the outer side in the negative direction of the X axis and the outer side in the positive direction of the X axis of the effective print area IR, and to perform four passes. In addition, references relating to the carriage 32 in FIG. 8 (solid line and dashed line) have the same meaning as those in FIG. 4.

Differently from the above embodiments, in the sixth embodiment, an optical sensor So is attached to a carriage 32, and integrally moves with the carriage 32. The optical sensor So is provided on the backward side in the X axis direction with respect to the carriage 32. As a result, a detection area Rs of the optical sensor So is located at the backward side in the X axis direction of the carriage 32. In the sixth embodiment with such a configuration, a printing operation as follows is performed.

In the first pass, the mark M is formed, and a line image L1 is formed. At this time, the detection area Rs of the optical sensor So passes through the mark M1 along with a movement of the carriage 32 in the positive direction of the X axis. In this manner, the mark M1 is detected by the optical sensor So, and position information on the mark M1 is output to the mechanical controller 420. On the other hand, the mechanical controller 420 stores the position of the mark M1 at this time as the initial position.

When the first pass is ended, sub-scanning is performed between the first and the second passes. In this sub-scanning, the carriage 32 moves in the Y axis direction by an initial set value $\alpha$ (that is, the movement distance Y32$=\alpha$). When the sub-scanning is ended, subsequently, the second pass is performed. In the second pass, the detection area Rs of the optical sensor So passes through the mark M1 along with the movement of the carriage 32 after forming a line image L2. In this manner, the mark M1 is detected by the optical sensor So, and position information of the mark M1 is output to the mechanical controller 420. On the other hand, the mechanical controller 420 obtains a displacement of the mark M1 at this time from the initial position.

In addition, the mechanical controller 420 determines a correction value $\Delta\alpha$ according to a displacement of the mark M1 obtained in this manner. Further, a value in which the correction value $\Delta\alpha$ is added to the initial set value $\alpha$ is set as the movement distance Y32 of the carriage 32 in the sub-scanning which is performed between the second pass and the third pass. In addition, in the sub-scanning, the carriage 32 moves in the Y axis direction by the movement distance Y32 ($=\alpha+\Delta\alpha$).

When this sub-scanning is ended, the third pass is performed. In addition, when the third pass is ended, the sub-scanning is performed between the third and the fourth passes. In the sub-scanning, the carriage 32 moves in the Y axis direction by the same movement distance Y32 as that between the previous second and third passes. Further, the fourth pass is performed subsequently to the third pass, and the printing of one frame is completed.

As described above, even the sixth embodiment has the configuration of detecting the displacement of the mark M1 which is formed on the sheet S in the Y axis direction. In addition, the movement distance Y32 which moves the recording head 34 in the Y axis direction in the sub-scanning is adjusted on the basis of the detection result. As a result, it is possible to suppress the occurrence of the above described gap.

Others

As described above, in the above embodiments, the printer 300 corresponds to the "image recording device" of the invention, the sheet S corresponds to the "recording medium", the ink corresponds to the "liquid", the platen 30 corresponds to the "support member" in the invention, the recording head 34 corresponds to the "recording head", the head controller 410 and the mechanical controller 420 function as the "control unit" of the invention in cooperation, the optical sensor So and the mechanical controller 420 correspond to the "detection unit" of the invention in cooperation, the X axis direction corresponds to the "main scanning direction", the Y axis direction corresponds to the "sub-scanning direction", and the movement distance Y32 corresponds to the "movement amount" of the invention.

In addition, the invention is not limited to the above described embodiments, and it is obvious that various changes may be made with respect to above descriptions without departing from the scope of the invention. For example, in the above described embodiments, the printer 300 of ink jet type is adopted as the image recording device, however, a liquid ejecting device which discharges or ejects liquid other than ink may be adopted. In addition, the invention can be applied to all of a variety of liquid ejecting devices including a liquid ejecting head or the like which ejects a small amount of liquid droplet. In this case, the liquid droplet means a state of liquid which is ejected from the liquid ejecting device, and includes a granular shape, a tear shape, and even includes a thing have a lasting effect on filamentous one.

In addition, the liquid mentioned here may be a material which can be ejected by the liquid ejecting device. For example, the liquid includes a liquid state in which a material in a liquid state is included in liquid, and viscosity thereof is high or low, sol, gel water, and flow-like body such as an inorganic solvent, an organic solvent, a solution, liquid resin, liquid metal (metallic metal), in addition to those. In addition, as a representative example of the liquid, there is ink which is described in the above embodiment, liquid crystal, or the like. Here, the ink includes various liquid composition such as common water-based ink, oil-based ink, gel ink, hot melt ink.

In addition, in the above described embodiment, it has a configuration in which the carriage 32 is moved in the Y axis direction in any of the sub-scanning which is performed in one frame, and the four line images of L1 to L4 are formed in this order by being aligned in the positive direction of the Y axis. However, the direction in which the carriage 32 is movable in the sub-scanning is not limited to the positive direction of the Y axis. That is, it is also possible to form the four line images of L1 to L4 in this order in a negative direction of the Y axis (that is, the opposite direction to those in the above described embodiments) by moving the carriage 32 in the negative direction of the Y axis in each the sub-scanning which is performed in one frame. Alternatively, it is possible to perform both the sub-scanning in which the carriage 32 is moved in the positive direction of the Y axis, and the sub-scanning in which the carriage 32 is moved in the negative direction of the Y axis in one frame. A specific example is as follows.

That is, the line image L1 in the first pass is formed, and the sub-scanning in which the carriage 32 is moved in the positive direction of the Y axis by the movement distance Y32 which corresponds to the width of line images of three lines, and then a line image L2 of the second pass is formed. In this manner, for example, a line image L2 of the second pass is formed at a position corresponding to the line image L4 in FIG. 4. Thereafter, the third and fourth passes are performed by moving the carriage 32 in the negative direction of the Y axis by the movement distance Y32 corresponding to the width of line image of one line, in the sub-scanning which is respectively performed in the second and third passes, and the third and fourth passes. Finally, line images of L1, L4, L3, and L2 are formed in this order by being aligned in the positive direction of the Y axis, in this manner. In addition, even in such a printing operation, it is possible to suppress the occurrence of the above described gap by adjusting the movement distance Y32 of the carriage 32 in the sub-scanning on the basis of the displacement of the mark formed on the sheet S in the Y axis direction.

In addition, in the above described embodiments, cases where the printing of one frame is performed in four passes has been mainly exemplified and described. However, the number of passes configuring the printing of one frame is not limited to four passes, and may be any plural number.

In addition, in the above described embodiments, the marks M1 to M3 has been formed on the sheet S by the recording head 34. However, it is possible to provide a functional unit which forms the marks M1 to M3 separately from the recording head 34. Alternatively, it is also possible to use a sheet S in which the marks M1 to M3 are formed in advance.

Regarding the shape of the marks M1 to M3, it is possible to adopt a variety of appearances, for example, borders shape which extends in the X axis direction, or the like. In addition, dimensions of the marks M1 to M3 can be appropriately changed. Further, in the above described embodiments, the marks M1 to M3 have been formed on the outer side of the effective print area IR in the X axis direction. However, the position of the marks M1 to M3 can be appropriately changed. When the arrangement of the optical sensor So is changed according to the change of the position of the marks M1 to M3, it is possible to realize the configuration of the invention in which the movement distance Y32 of the carriage 32 in the sub-scanning is adjusted by detecting the displacement of the marks M1 to M3.

In addition, in the above described embodiments, the line sensor has been used when configuring the detection unit. However, it is possible to configure the detection unit using a sensor other than the line sensor. In short, it may be any sensor which can detect the marks M1 to M3 which are formed on the sheet S.

In addition, in the above described embodiments, a case where the invention is applied to the piezoelectric ink jet type printer has been described. However, it is needless to say that the invention can be applied to a thermal ink jet type printer, as well.

In addition, in the above described embodiments, a case where the printing operation is performed by reciprocating scanning of the carriage 32 in the X axis direction has been exemplified and described. However, the invention can be applied to a configuration in which the carriage 32 is subject to main scanning only in a single direction of the X axis direction when performing the printing.

What is claimed is:

1. An image recording device comprising:

a supporting member which supports a recording medium;

a recording head which is movable in a main scanning direction and a sub-scanning direction, and ejects liquid onto the recording medium supported by the supporting member;

a control unit which alternately performs, main-scannings in which the recording head is moved in the main-scanning direction while the recording head ejecting the liquid to form line images that extend in the main scanning direction and are adjacent to each other in the sub-scanning direction, and sub-scannings in which the recording head is moved in the sub-scanning direction; and a detection unit which detects a displacement of a mark which is formed on the recording medium in the sub-scanning direction, wherein the control unit adjusts a movement amount of the recording head which is moved in the sub-scanning direction in the sub-scannings on the basis of a detection result of the detection unit.

2. The image recording device according to claim 1, wherein the mark is formed on the recording medium with the recording head by ejecting the liquid on the recording medium.

3. The image recording device according to claim 2, wherein the control unit adjusts the movement amount of the recording head in the sub-scanning on the basis of the displacement, which is the detection result of the detection unit, of the mark having been formed by the recording head.

4. The image recording device according to claim 2, wherein the mark is formed on the recording medium with the recording head by ejecting the liquid onto the recording medium while moving in the main scanning direction.

5. The image recording device according to claim 4, wherein the line image is formed after forming the mark in the main scannings.

6. The image recording device according to claim 4, wherein the mark is formed while performing a first main scanning among a plurality of main scannings which forms the line images adjacent to each other in the sub-scanning direction.

7. The image recording device according to claim 1, wherein a plurality of the marks are formed in different positions from each other in the sub-scanning direction.

8. The image recording device according to claim 1, wherein the detection unit includes a line sensor of which a longitudinal direction of a detection area is arranged parallel to the sub-scanning direction, and detects the displacement of the mark in the sub-scanning direction on the basis of a detection result of the line sensor.

9. The image recording device according to claim 1, wherein the recording medium is a paper-based medium.

10. The image recording device according to claim 1, wherein the recording medium is a film-based medium.

11. The image recording device according to claim 10, wherein the support member heats the recording medium supported by the support member.

12. A method of image recording comprising:

alternately performing, main-scannings in which the recording head moves in the main-scanning direction while the recording head ejecting the liquid to form line images that extend in the main scanning direction and are adjacent to each other in the sub-scanning direction, and sub-scannings in which the recording head moves in the sub-scanning direction; and adjusting the movement amount of the recording head in the sub-scanning on the basis of the displacement, which is the detection result, of the mark having been formed on the recording medium.

* * * * *